United States Patent [19]

Wiggins

[11] Patent Number: 4,642,823

[45] Date of Patent: Feb. 17, 1987

[54] SOFA BED RECLINER

[75] Inventor: William B. Wiggins, New York, N.Y.

[73] Assignee: Robert Fireman's Furniture Gallery, Inc., New York, N.Y.

[21] Appl. No.: 689,658

[22] Filed: Jan. 8, 1985

[51] Int. Cl.[4] ..... A47C 23/00

[52] U.S. Cl. ..... 5/47; 5/37 R; 5/41

[58] Field of Search ..... 5/18 R, 37 R, 41, 47, 5/48, 55 B

[56] References Cited

U.S. PATENT DOCUMENTS

| | | | |
|---|---|---|---|
| 715,114 | 12/1902 | Mooers | 5/47 |
| 828,124 | 8/1906 | Kelly | 5/47 |
| 941,186 | 11/1909 | Brown | 5/55 B |
| 2,314,864 | 3/1943 | Bergstrom | 5/47 |
| 2,337,712 | 12/1943 | Fox | 5/47 |
| 2,375,716 | 5/1945 | Wilson | 5/47 |
| 3,107,364 | 10/1903 | Simmons | 5/41 |
| 3,634,893 | 1/1972 | Horn et al. | 5/37 R |

FOREIGN PATENT DOCUMENTS

| | | | |
|---|---|---|---|
| 3210986 | 3/1983 | Fed. Rep. of Germany | 5/47 |

*Primary Examiner*—Gary L. Smith
*Assistant Examiner*—Michael F. Trettel
*Attorney, Agent, or Firm*—Auslander & Thomas

[57] ABSTRACT

A sofa bed recliner, particularly adapted for use with a futon as a mattress and seat cushion is adapted to move from a seat to a recliner to a bed without need to rearrange the futon. The back frame does not extend backward when moved. The sofa bed recliner is adapted to function as a full double bed with the seat frame and back frame supported and interlocked. An arm is adapted for the interengagement of the seat frame and back frame to facilitate the returning of the sofa bed recliner to its seat position.

4 Claims, 10 Drawing Figures

SOFA BED RECLINER

The present invention is a new sofa bed recliner.

The present invention is particularly adapted for use with a futon. Futons have become popular, offering the advantage of convertible structure adaptable for both sitting and sleeping. The present invention is a support structure for a futon, having the combined advantage of a supported seat and a full-length sofa bed recliner, the futon being used on the sofa bed recliner as a combination seat cushion and mattress which can function without having to be removed as the sofa bed recliner transforms from a sofa, to a bed and to a recliner. The sofa bed recliner of the present invention is in effect an adaptable futon or mattress or cushion support styled to function as a unique sofa bed recliner.

A mattress may be use with the sofa bed recliner of the present invention. A futon when used in conjunction with the support of the present invention has the distinct advantage of functioning as a comfortable mattress as well as a seat cushion and backrest in all positions, seat, recliner and bed without having to be shifted on its sofa bed recliner support.

The present invention has the advantage of the space saving of a futon supported on a structure, which also saves space.

Where the sofa bed recliner of the present invention is placed against a wall, the opening of the sofa bed recliner moves the back frame forward and downward on the base in a smooth transition from seat to recliner to bed. There is a base which acts as a means to mount the seat frame and back frame. The back frame flattens as it moves forward, from its upright position to a horizontal position. In so doing, the back frame slides forward without any backward movement, allowing the sofa bed recliner to be fully opened without having to move the sofa bed recliner backwards from its fixed position, when it is against the wall. The same structure also has the full advantage of being able to retain a set position in its transition from seat to bed to be fully functional as a recliner.

In a preferred embodiment, the length and width of the back frame and the seat frame are such that, when opened into a horizontal position for sleeping, the back frame and seat frame are the full size of a double bed supported on the mount means.

In order to enable effective use of the support as sleeping furniture, a pair of legs is extendable underneath the projecting seat frame. The seat frame and back frame are preferably interlockable to be retained as a unitary horizontal futon or mattress support.

The interlock is effected by a dowel or rod extendable through the seat frame and back frame. The interlock prevents shifts of body weight from separating the frames while the legs prevent over balance.

In a preferred embodiment a linkage between the rotatable legs and a rod, extends the rod through an opening in the seat frame, through a juxtaposed opening in the back frame, safely locking the back and seat frame in their horizontal position.

In another embodiment of the present invention, the seat frame and back frame are interactable to effect and easy transition back from the bed to seat function of the sofa bed recliner of the present invention.

An object of the present invention is to provide a sofa bed recliner useable in selected transitional positions from seat to recliner to a bed.

A further object of the present invention is to provide a sofa bed recliner preferably adapted to support a futon adapted to function in all selected positions between seat, recliner and bed without need for substantial adjustment.

Another object of the present invention is to provide a sofa bed recliner, which, when opened, has an interlockable seat frame and back frame.

Another object of the present invention is to provide a sofa bed recliner, wherein the opening of the sofa bed recliner, the back frame moves forward to a horizontal position without extending any further backward from its normal upright position.

Another object of the present invention is to provide a rigid interlock between the seat frame and the back frame, when the sofa bed recliner is in a horizontal position.

Another object of the present invention is to provide an extendable set of support legs to prevent overbalancing of the structure when in bed position.

Another object of the present invention is to provide an interlock between seat frame and back frame actuatable by extending the support legs.

Another object of the present invention is to provide a seat frame and back frame interactable to effect and easy transition back from the bed to seat position of the sofa bed recliner of the present invention.

The prior art is replete with sofa bed structures, including sofa bed structures adapted to open at a centerfold to convert the back rest and seat into a double bed sleeping structure, such as found in U.S. Pat. No. 2,769,987 to Thal, or U.S. Pat. No. 1,982,930 to Russo. The prior art has not dealt with the simple structure particularly adapted to support a futon, where an effective seat, recliner and double bed can be made available. U.S. Pat. No. 4,205,405 to Bennett, while disclosing a sofa bed alone where the opening of the sofa bed does not require moving of the sofa bed away from the wall, the supported structure of the open sofa bed is complex and requires piecing together of the mattress portion in order to use the sofa bed for sleep, as distinguished from the simple opening of the support structure providing a futon, mattress or cushion in place. There is further, no intermediate use as a recliner. U.S. Pat. Nos. 4,104,747 to Bell and 4,048,680 to Rodgers, Jr., both typify the complex linkages of the past, generally provided in metal structures, to support the opened back frame and seat of the prior art sofa bed structure.

Further, the prior art, which is typified in U.S. Pat. No. 412,881 to Alfana, has usually been dependent upon integral use of cushions, as distinguished from the placement of a futon, facilitated by the structure of the present invention.

There is a non-recliner metal frame structure on the market in which, in the conversion from sofa to bed, a supported back frame, linked to a seat frame, is overturned to flatten into a horizontal position as the seat frame is guided forward in its base or mounting means. This structure though, is not adapted to be used as a recliner and cannot be converted to its horizontal position with a futon or mattress already in place.

Although such novel feature or features believed to be characteristic of the invention are pointed out in the claims, the invention and the manner in which it may be carried out may be further understood by reference to the description following and the accompanying drawings.

Referring now to the figures in greater detail, where like reference numbers denote like parts in the various figures.

Figure 1:
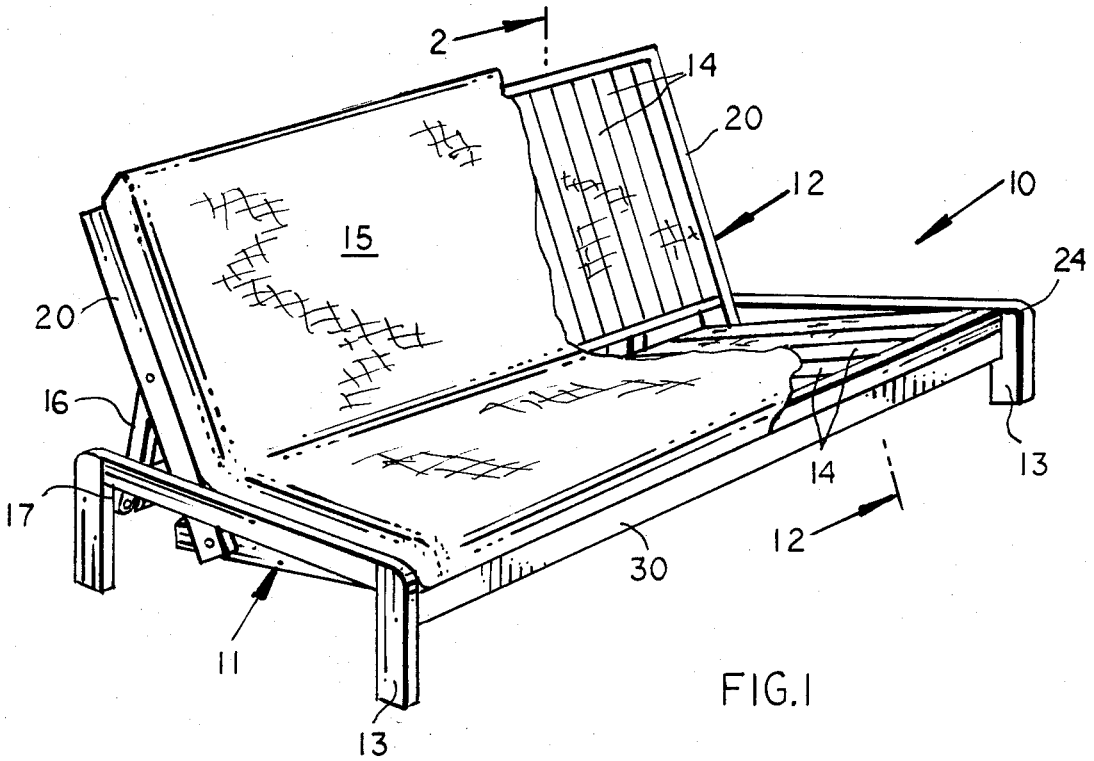
FIG. 1 is a perspective view of the sofa bed recliner of the present invention with a futon partially cut away.

The sofa bed recliner 10, as shown in FIG. 1, includes a seat frame 11, back frame 12 and mount 13 which serves as a base for the seat frame 11 and back frame 12. The seat frame 11 and back frame 12 are provided with webbing 14 usually in the form of slats or metal spring webbing. As can be seen in FIG. 1, a futon 15 is placed over the webbing 14 of the seat frame 11 and back frame 12, providing the basic cushioning for the seat position when the sofa bed recliner 10 of the present invention is in its seat position. Preferably, the seat frame 11 and back frame 12 are the full length of a bed and when in a horizontal position, open to the size of a normal double bed.

Figure 2:
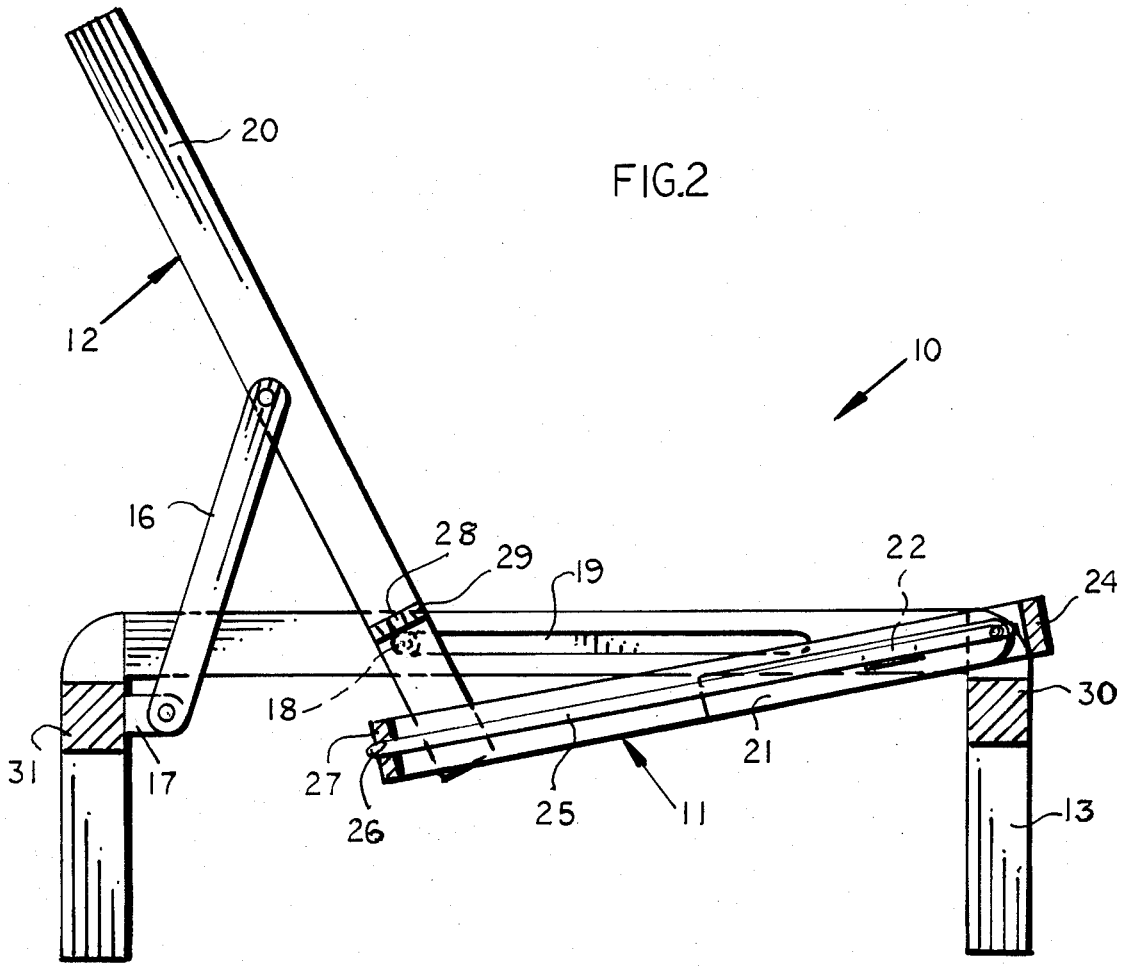
FIG. 2 is a section of FIG. 1 at lines 2—2.

As shown in FIG. 2, the back frame 12 is mounted to the mount 13 by a support 16 pivotally mounted on an L bracket 17 at one end and pivotally mounted on the back frame 12 at the other. A wheel 18 extends from the frame 12 and is rollably engaged in the groove 19 so that the back frame 12 may rotate as it moves in the groove 19. The wheel 18 and groove 19 interact to pivot the back frame 12 allowing it to move horizontally, guided, with respect to the mount 13 and to pivot to a horizontal position juxtaposed to the seat frame 11.

The end rails 20 of the back frame 12 extend beyond the rectangular configuration of the basic back frame 12 and are pivotally attached to the seat frame 11 at both ends.

Figure 5:
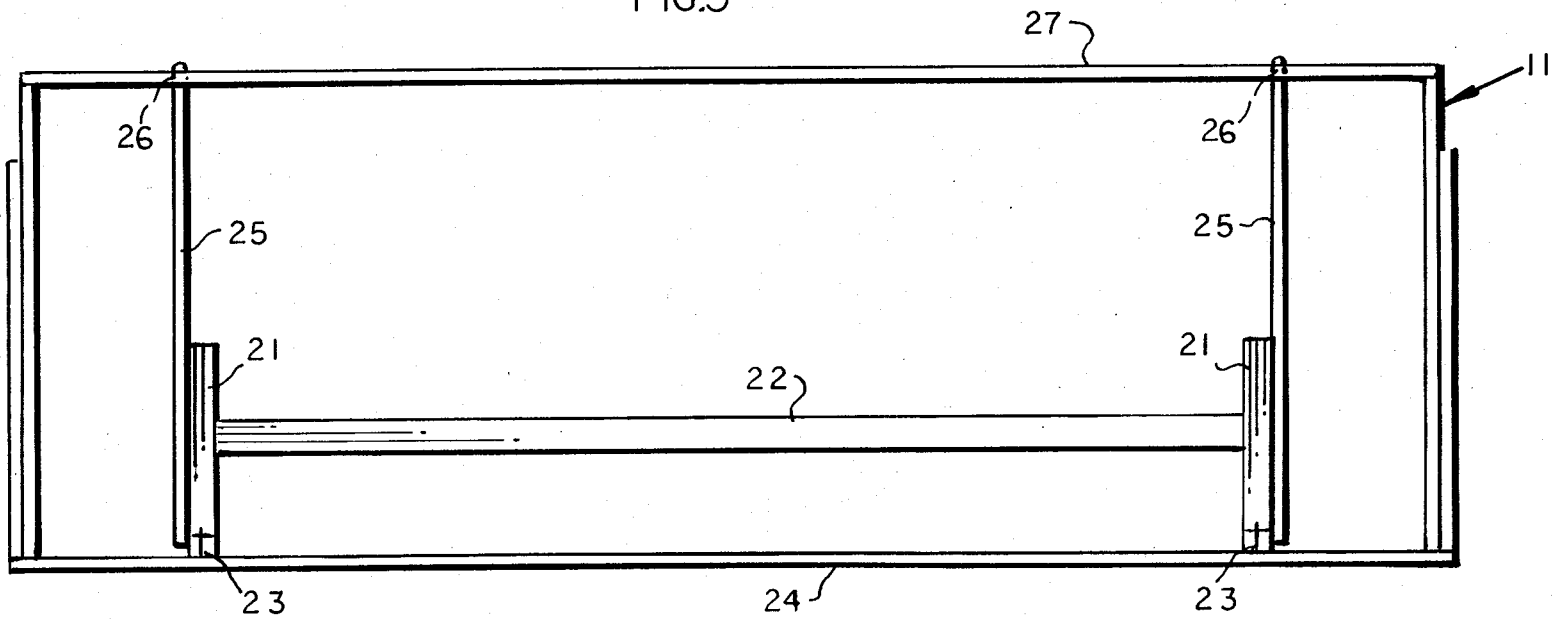
FIG. 5 is a bottom plan view of the seat frame shown without webbing, showing the retracted support legs.
Figure 3:
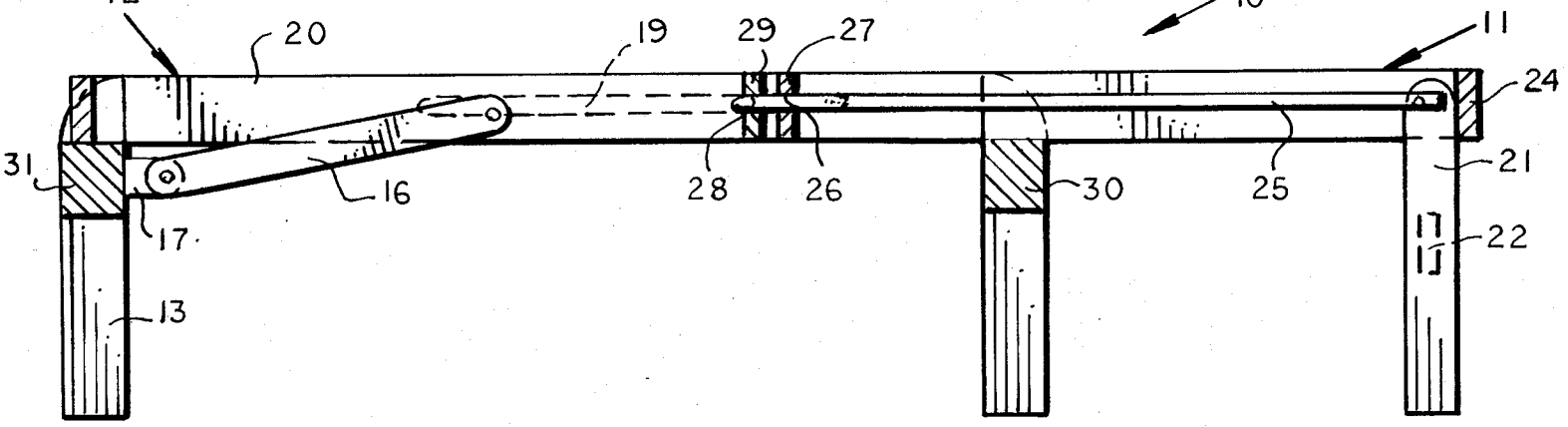
FIG. 3 is a section of the sofa bed recliner of the present invention; in its horizontal position with auxiliary support legs extended and the seat frame and back frames interlocked.

The seat frame 11, as shown in FIGS. 3 and 5, includes a pair of legs 21 joined by a cross piece 22, pivotally mounted on L brackets 23, to the front rail 24 of the seat frame 11.

Figure 6:
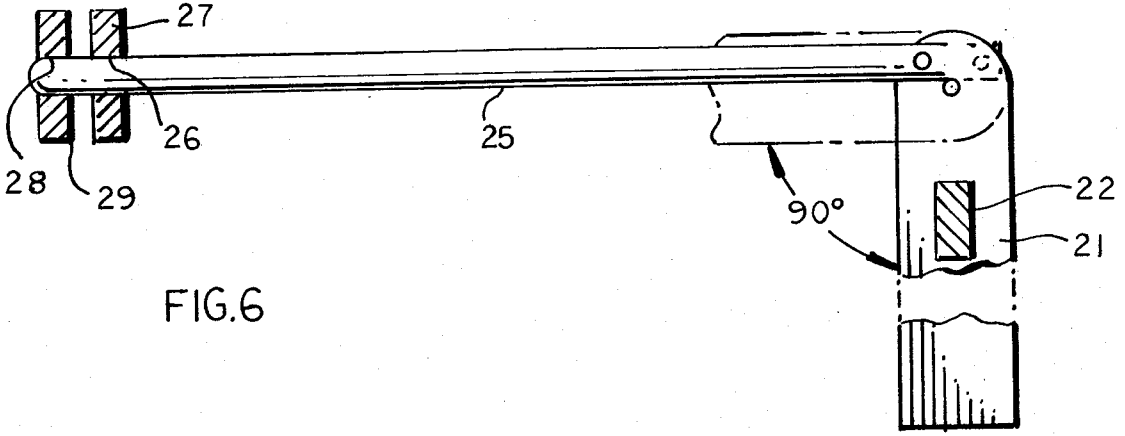
FIG. 6 is a detail of the extendable support legs showing a dowel interlocking the two frames.
Figure 4:
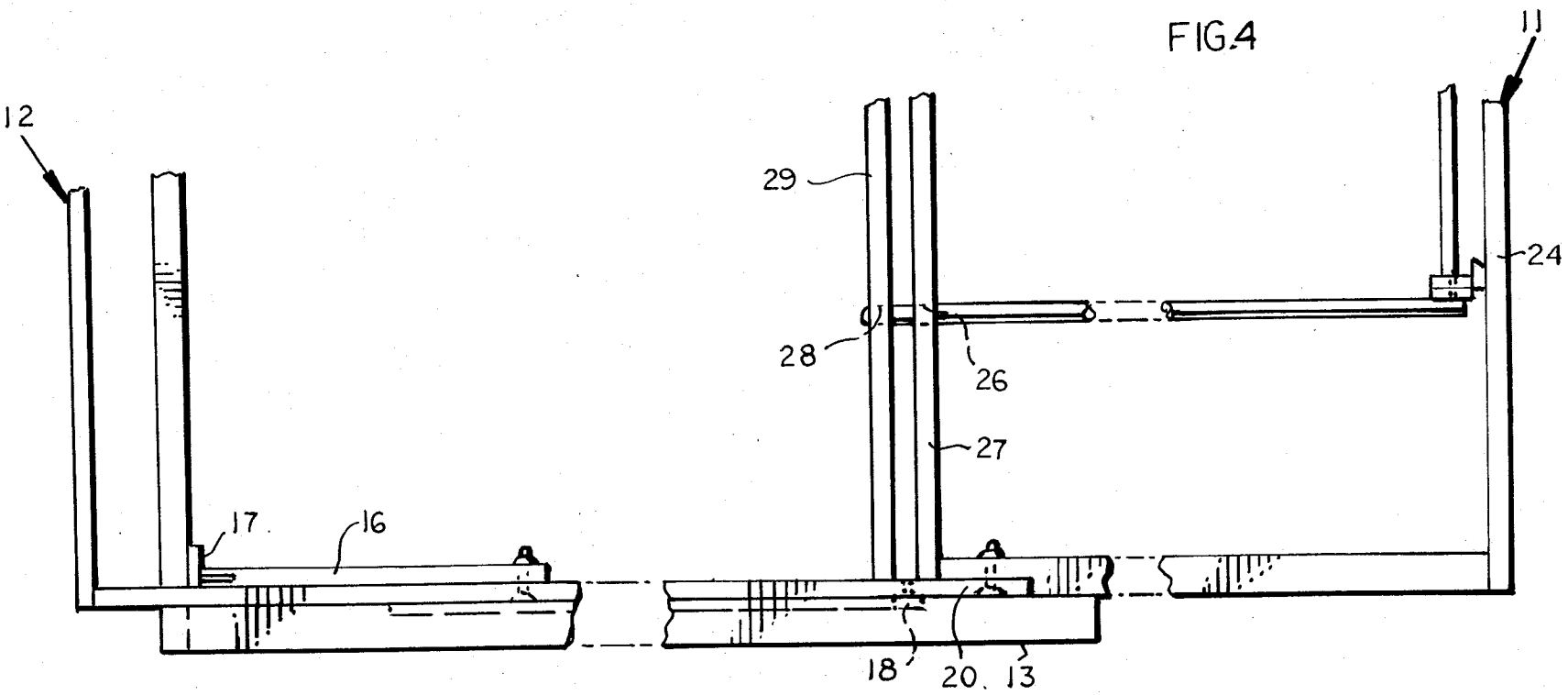
FIG. 4 is a broken away top plan view of the interlocked open frames shown without webbing.

As shown in detail FIG. 6 and in FIGS. 2 and 6, a dowel 25 or a rod is eccentrically pivotally mounted on the legs 21 so that when the legs 21 are in in open position the dowel 25, which extends through an opening 26 in the rear rail 27 is further extended and engaged in an opening 28 in the front rail 29 of the back frame 12.

In operation the sofa bed recliner 10, as shown in FIG. 1, being used as a seat, has a futon 15 placed over the back frame 12 and seat frame 11 to serve as a normal sofa cushion.

The seat frame 11 rests on the front cross piece 30 at one end and is pivotally mounted to the end rails 20 which have ends extending beyond the front rail 24 of the back frame 12. The seat frame 11 is supported at its other end by a pivot mount. The back frame 12 is held by the support 16 and the wheel 18. The support 16 is pivotally mounted at one end to the L bracket 17 and at the other end to the back frame 12. The wheel 18 is engaged in the groove 19 which is also pivotally mounted on the back frame 12. Thus when the seat frame 11 is pulled forward to open the sofa bed recliner 10 as a bed, the back frame 12 moves forward guided by the wheel 18 in the groove 19 while the back frame 12 tilts backward as the seat frame 11 and back frame 12 flatten into a bed.

The sofa bed recliner 10 does not have to be moved to be opened even if it is backed up to a wall since the back frame 12 pulls forward as it moves downward without moving any further back. In its open, horizontal position, the back frame 12 rests on the rear cross piece 31 of the mount 13.

Since the back frame 12 moves forward to open, the seat frame 11 compensates by protruding, as can be seen in FIG. 3, thus it is important to provide legs 21 to prevent the weight of a sleeper from over balancing the sofa bed recliner 10. The legs 21 are rotated downwardly from their retracted position in the back frame 12 to provide the necessary support. At the same time the legs 21 are rotated downwardly, the dowel 25 is extended through an opening 28 in the back frame 12, interlocking the seat frame 11 and back frame 12 as a rigid bed, which cannot collapse in the middle from body weight.

In the preferred embodiment the seat frame 11 and back frame 12 are equal in width to half of a double bed and in length to the full length of a double bed, thus when opened, with a futon 15 used as a mattress the sofa bed recliner 10 serves as a full double bed.

The seat frame 11 and back frame 12 can hold relative selected positions and function as a recliner if desired.

In the embodiment of the sofa bed recliner 10 as shown in FIGS. 7-10 an arm 40 is pivotally mounted to at least one of the end rails 20 to facilitate the closure of the bed and the resetting of the seat position of the sofa bed recliner 10. An arm 40 is mounted on an end stave 20 of the back frame 12 adjacent a support 16. The support 16 and and arm 40 are joined beyond the pivot point of the arm 40 at a short distance from the pivot point. The spring 41 is preferably a round coil spring looped from the arm 40 to the support 16 so that its spring tension resides in its tendency to straighten.

Figure 7:
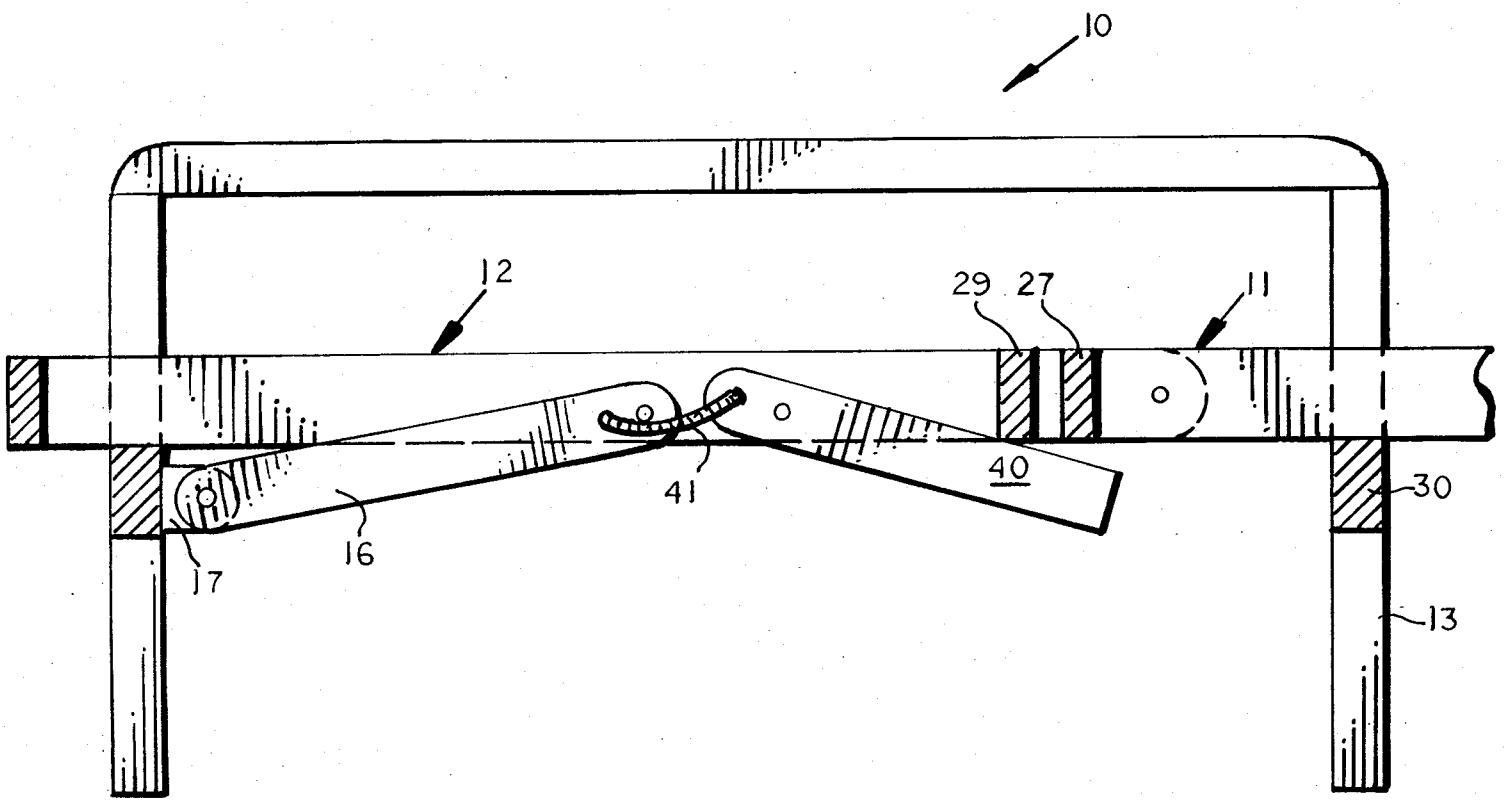
FIG. 7 is a side section of an embodiment of the sofa bed recliner of the present invention in a horizontal position.

As shown in FIG. 7 the arm 40 extends underneath and beyond the rear rail 27 of the seat frame 11 when the sofa bed recliner 10 is in a horizontal position. The tension of the spring 41 tends to separate the support 16 and the arm 40 tending to rotate the arm 40 downward about its pivot point and clear of the seat frame 11.

Figure 8:
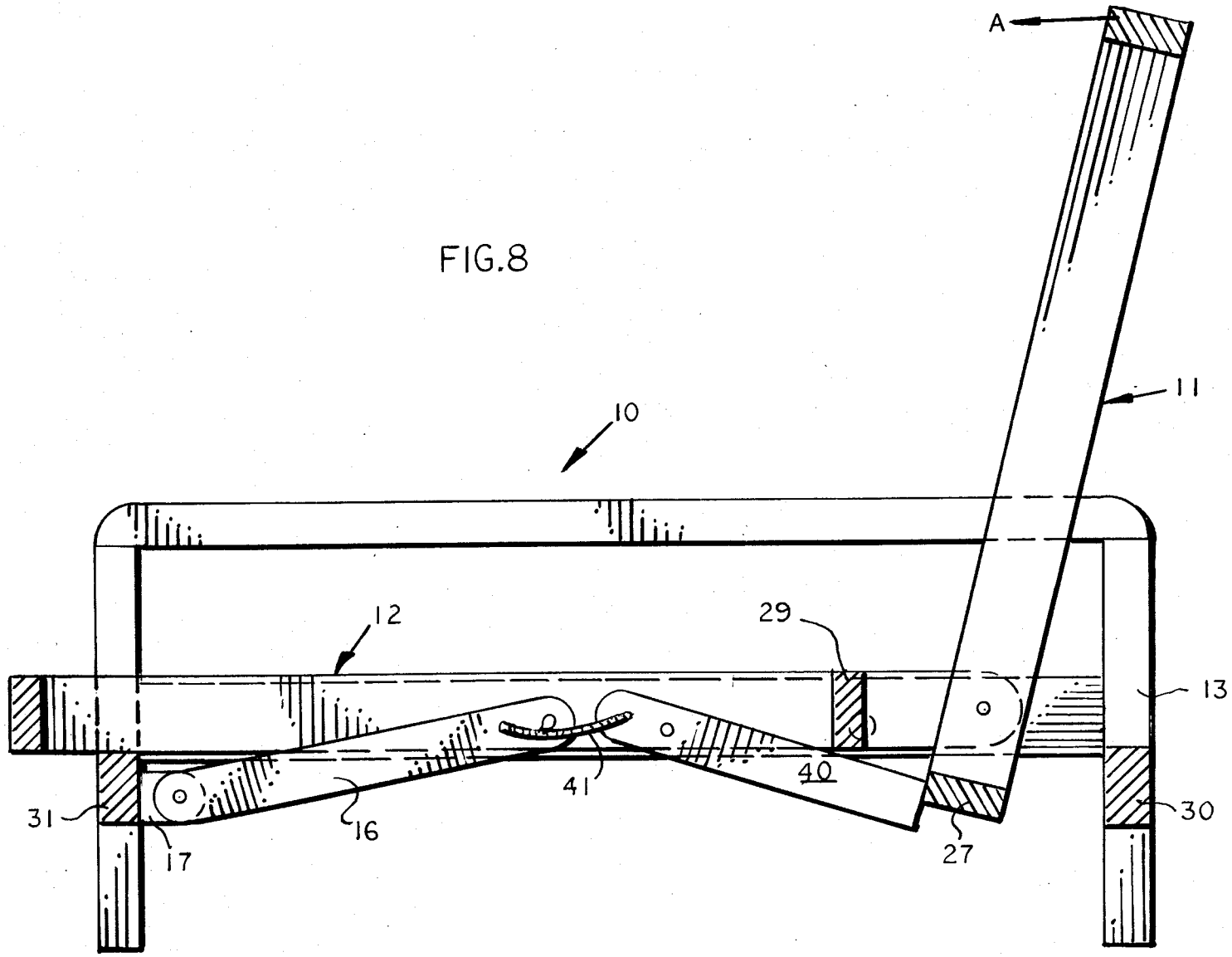
FIG. 8 is a view of FIG. 7 with the seat frame and an interlock arm engaged preparatory to resetting the sofa bed recliner to its seat position.
Figure 9:
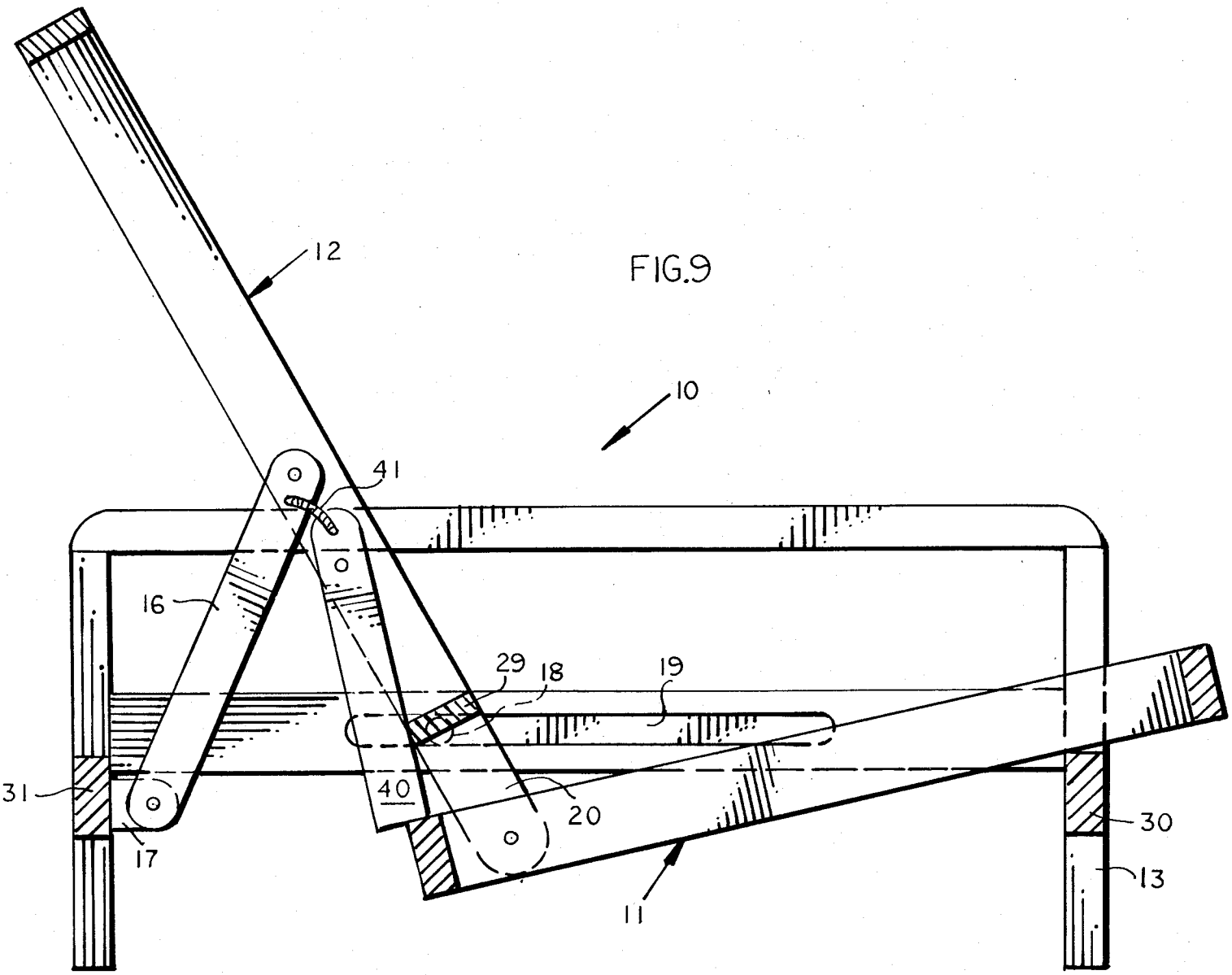
FIG. 9 is a view of FIG. 7 with the seat frame and back frame returned to the seat position.

Returning the sofa bed recliner 10 to its seat position the seat frame 11 can be lifted then moved in the the direction of arrow A as shown in FIG. 8. In so doing the rear rail 27 slides past the end of the arm 40. The arm 40 remains substantially in the same position, thus when the seat frame 11 is moved downward the rear rail 27 engages the flat end of the arm 40 interengaging the seat frame 11 the arm 40 and the back frame 12. As the seat frame 11 is move further downward the back frame 12 pivots upward in relation to the seat frame 11 as the wheel 18 rolls backward in the groove 19 and the support 16 pivots upward rotating from the L bracket 17. As the back frame 12 moves upward as the back frame 12 and seat frame 11 pivot with relation to each other, the arm 40 is released from its engagement with the rear rail 27 since the radius from the pivot point of the seat frame 11 and the back frame 12 is greater than the length of the arm 40 extending from the arms's pivot point.

Figure 10:
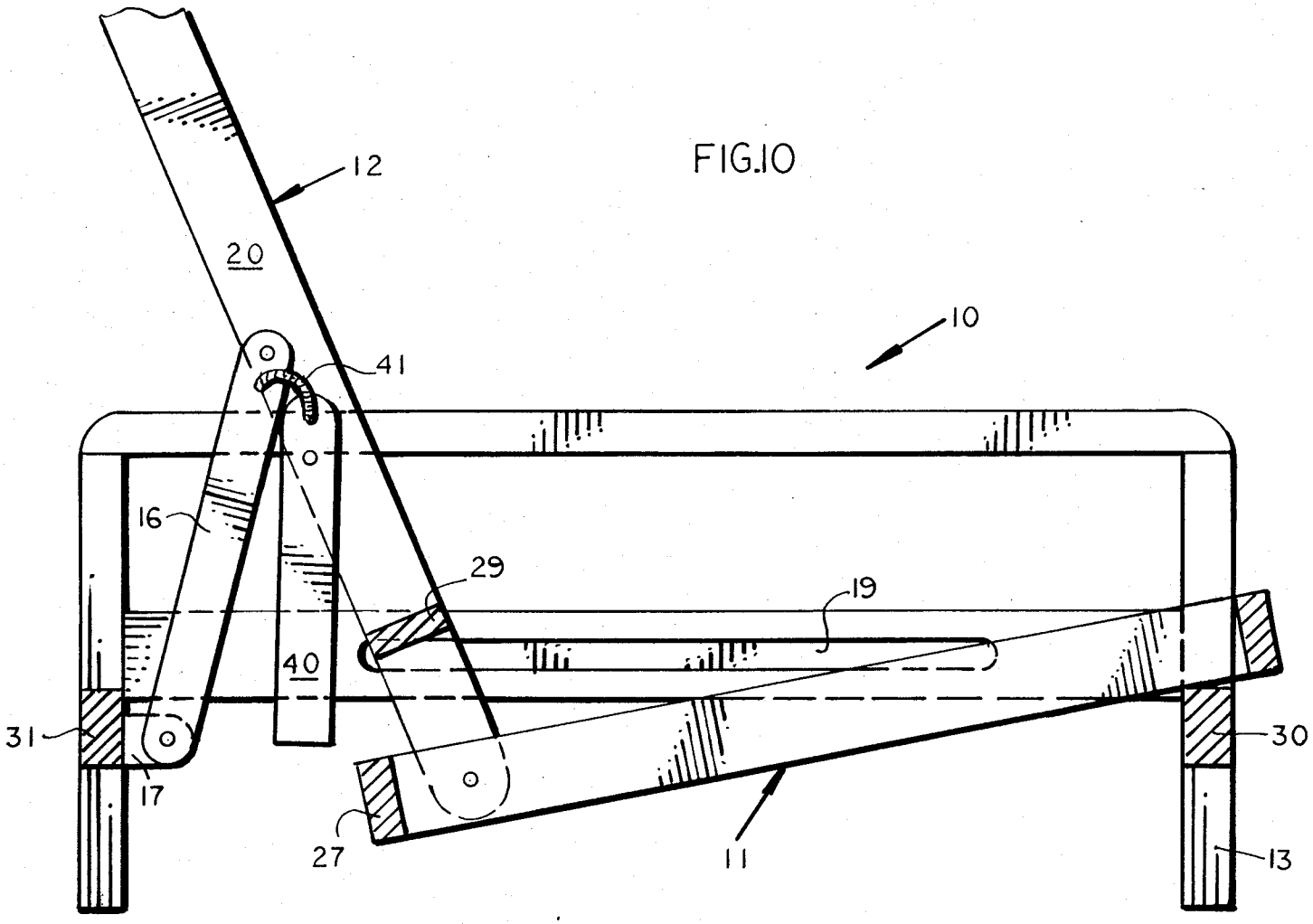
FIG. 10 is a view of FIG. 7 in seat position with the interlock arm disengaged.

As shown in FIG. 10 the arm 40 is swung clear of the rear rail 27 when the sofa bed recliner 10 is in seat position. The spring 41 acting on the arm 40 tends to rotate the arm 40 about its pivot holding it clear of the seat frame 11 and the rear rail 27. In opening the sofa bed recliner 10 to its horizontal position the arm 40 hangs clear of engagement with the rear rail 27 of the seat frame 11. Moving the seat frame 11 outward elevates it lifting the seat frame 11 beyond the end of the arm 40 which is held clear by the spring 41 so that when the sofa bed recliner 10 is in a horizontal position as shown in FIG. 7 the arm 40 is beneath the seat frame 11 and rear rail 27.

The shortness of the spring 41 also keeps the arm 40 in position to reengage the rear rail 27 as shown in FIG. 8. since the arm 40 if not held by the spring 41 would hang in a vertical position and would not be able to engage the rear rail 27 as shown in FIG. 8.

While the spring 41 helps reassure the proper interaction between the rear rail 27 and the arm 40, its primary function is as a tether to maintain the arm 40 in position as shown in FIGS. 7 and 8.

It is understood the following claims are intended to cover all of the generic and specific features of the invention herein described, and all statements of the scope of the invention which, as a matter of language, might fall therebetween.

Having described certain forms of the invention in some detail, what is claimed is:

1. A sofa bed recliner comprising a seat frame; a back frame; a base; at least one support arm; and interactive guide means, said back frame including a rear rail; a front rail; and end rails, said seat frame including a rear rail; a front rail; and end rails, said end rails of said back frame and said end rail of said seat frame being pivotally joined, said base including end portions; a rear cross piece; and a front cross piece, said cross pieces joining said end portions, said seat frame slideably resting on said front cross piece of said base, said interactive guide means comprising a groove and a wheel that slideable supports the back frame upon said base end portions as to guide said frames forward to a horizontal position and back to a sitting position, said at least one support arm pivotally mounted at the rear of said base at one end and on said back frame at its other end, said front rail of said back frame and rear rail of said seat frame each including at least one opening, said openings adapted to be juxtaposed when said seat frame and back frame are in horizontal position, said seat frame including at least one leg pivotally mounted by the front rail of seat frame, said leg adapted to be rotated to extend vertically of said seat frame to a support position, a rod pivotally mounted on said at least one leg, as to be eccentric of the pivot point of said leg, said rod extending horizontally through said back and seat frame openings when said seat frame and said back frame are in horizontal position and said leg is rotated to its support position, and at least one arm adjacent said at least one support, said arm pivotally mounted to said back frame, said arm being longer than the distance from said arm's pivot point to said seat frame's rear rail when said back frame and seat frame are in horizontal position and shorter than the distance from said pivot point to said seat frame's rear rail when said back frame and said seat frame are in sitting position said arm including a biasing tether extending between said support arm at its other end adjacent the back frame to aid arm beyond its pivot point adjacent said support arm whereby said arm is interlocable with said seat frame's rear rail to said frames to revert them to sitting position and said tether is adapted to pivot said arm clear of said seat frame when said back frame is in sitting position.

2. The sofa bed recliner of claim 1 wherein said tether is a spring.

3. The sofa bed recliner of claim 2 wherein said spring is a coil spring.

4. The sofa bed recliner of claim 3 wherein said spring is biased between said support and said arm as to pivot said arm clear of said seat frame when said back frame is in seat position.

* * * * *